US005565645A

United States Patent [19]

Tappan, II et al.

[11] Patent Number: 5,565,645

[45] Date of Patent: Oct. 15, 1996

[54] HIGH-INTENSITY INFRARED DECOY FLARE

[75] Inventors: Ralph S. Tappan, II, Brigham City; Richard C. Anderson, Logan; David W. Endicott, Jr., Mendon, all of Utah

[73] Assignee: Thiokol Corporation, Ogden, Utah

[21] Appl. No.: 427,616

[22] Filed: Apr. 24, 1995

[51] Int. Cl.[6] ..... F42B 4/06

[52] U.S. Cl. ..... 102/336; 102/350

[58] Field of Search ..... 102/336, 350

[56] References Cited

U.S. PATENT DOCUMENTS

| | | | |
|---|---|---|---|
| 2,690,711 | 10/1954 | Jackson | 102/70 |
| 3,613,583 | 10/1971 | Lai | 102/37.8 |
| 3,970,003 | 7/1976 | Hayward et al. | 102/37.8 |
| 4,044,683 | 8/1977 | Ostroff | 102/90 |
| 4,171,669 | 10/1979 | Allen | 102/37.6 |
| 4,452,039 | 6/1984 | Hodgkins et al. | 102/336 X |
| 4,463,679 | 8/1984 | Billard | 102/336 X |
| 4,624,186 | 11/1986 | Widers et al. | 102/336 X |
| 4,739,708 | 4/1988 | Halpin et al. | 102/336 X |
| 5,056,435 | 10/1991 | Jones et al. | 102/336 X |
| 5,074,216 | 12/1991 | Dunne et al. | 102/334 |
| 5,400,712 | 3/1995 | Herbage et al. | 102/336 X |

OTHER PUBLICATIONS

Beckstead et al., *Nonacoustic Combustor Instability,* AIAA Journal, vol. 5, No. 11 (Nov. 1967).

*Primary Examiner*—Peter A. Nelson

*Attorney, Agent, or Firm*—Madson & Metcalf; Ronald L. Lyons

[57] ABSTRACT

An infrared decoy flare having enhanced infrared intensity is disclosed. The flare includes a case in which an infrared illuminant composition is disposed. The bore diameter and length of the case are advantageously selected to be compatible with preexisting chaff dispensers and their cartridges located on aircraft. The illuminant composition, the nozzle throat area, the geometry of the illuminant composition, and the volume of the combustion chamber are selected such that combustion of the illuminant composition results in an unstable combustion condition during the first second of combustion, thereby increasing the peak intensity of the radiation emitted by the propellant. Preferably, the flare is configured such that the unstable combustion occurs during the first 0.2 to 0.5 seconds of combustion of the illuminant composition.

17 Claims, 3 Drawing Sheets

HIGH-INTENSITY INFRARED DECOY FLARE

BACKGROUND

1. The Field of the Invention

The present invention is related to a decoy flare for use as a countermeasure device against radiation-seeking missiles. More particularly, the present invention is related to a flare design capable of substantially increasing the peak intensity produced by the flare by achieving an unstable combustion condition.

2. Technical Background

Decoy flares are used defensively by combat aircraft to evade heat-seeking missiles directed at such aircraft by an enemy. At an appropriate time after the enemy launches a heat-seeking missile, the targeted aircraft releases a decoy flare. The decoy flare burns in a manner that simulates the engines of the targeted aircraft. Ideally, the missile locks onto and pursues the decoy, permitting the targeted aircraft to escape unharmed.

Early decoy techniques utilized bundles of chaff, i.e., strips of metal which would reflect radar energy to counter radar guided missiles. The chaff bundles were housed in square or rectangular shaped cartridges which were held in correspondingly shaped dispensers on the aircraft.

However, the advancement of missile technology has resulted in the development of missiles which examine a potential target's energy spectrum in order to distinguish decoys from targeted aircraft using infrared wavelength signatures. Typical of such missiles are missiles which target an infrared light source.

The burn requirements of the decoy flare must therefore be determined by reference to the known characteristics of the targeted aircraft's engine emissions as interpreted by the heat-seeking missile. It is necessary for the decoy to emit light in the infrared (IR) spectrum and for a duration that will induce the missile to lock onto the decoy instead of the escaping aircraft.

One problem which has been encountered in the development of suitable IR decoy flares is the difficulty of achieving sufficient intensity in the infrared signal being produced by the flare. Because IR seeking missiles are known to target high intensity IR emissions, the effectiveness of a decoy flare could be increased substantially if the intensity of the IR light produced by the flare is increased.

Merely increasing the amount of illuminant in the flare is an unsatisfactory solution because of the physical requirement that the decoy flare be capable of being carried in already existing chaff dispensers.

From the foregoing, it will be appreciated that it would be an advancement in the art to provide an IR flare which is capable of emitting IR light at a substantially greater intensity than previously known IR flares, while having a geometric configuration which permits it to be used with presently existing chaff dispensers.

Such a device is disclosed and claimed herein.

BRIEF SUMMARY AND OBJECTS OF THE INVENTION

The present invention is directed to a novel decoy flare having enhanced infrared intensity. The flare includes a case in which an infrared illuminant composition is disposed. The illuminant composition also acts as a propellant, thereby enabling the decoy flare to be propelled in a direction which is beneficial in countering air-to-air and surface-to-air missiles.

The bore diameter and length of the case are advantageously selected to be compatible with preexisting chaff dispensers and their cartridges located on aircraft which employed the ejection of chaff bundles as a radio frequency countermeasure device.

The case includes a shroud which is configured with a plurality of holes. The size, shape, number, and arrangement of the holes is selected to determine the "effective length" of the case while achieving a predetermined actual length to satisfy any ejection and packaging requirements imposed on the flare.

The illuminant composition, the nozzle throat area, the geometry of the illuminant composition, and the volume of the combustion chamber are selected such that combustion of the illuminant composition results in an unstable combustion condition during the first second of combustion, thereby increasing the peak intensity of the radiation emitted by the propellant. Preferably, the flare is configured such that the unstable combustion occurs during the first 0.2 to 0.5 seconds of combustion of the illuminant composition.

The duration and start time of unstable combustion are controlled by selecting of the appropriate relationship between the illuminant composition, the nozzle throat area, the geometry of the illuminant composition, and the volume of the combustion chamber. Thus, the flare may be configured such that peak intensity output occurs at a critical time period to most effectively counter air-to-air and surface-to-air missiles.

Thus, it is an object of the present invention to provide an IR flare which is capable of emitting IR light at a substantially greater intensity than previously known IR flares, while having a geometric configuration which would permit it to be used with presently existing chaff dispensers.

These and other objects and advantages of the present invention will become more fully apparent by examination of the following description of the preferred embodiments and the accompanying drawings.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
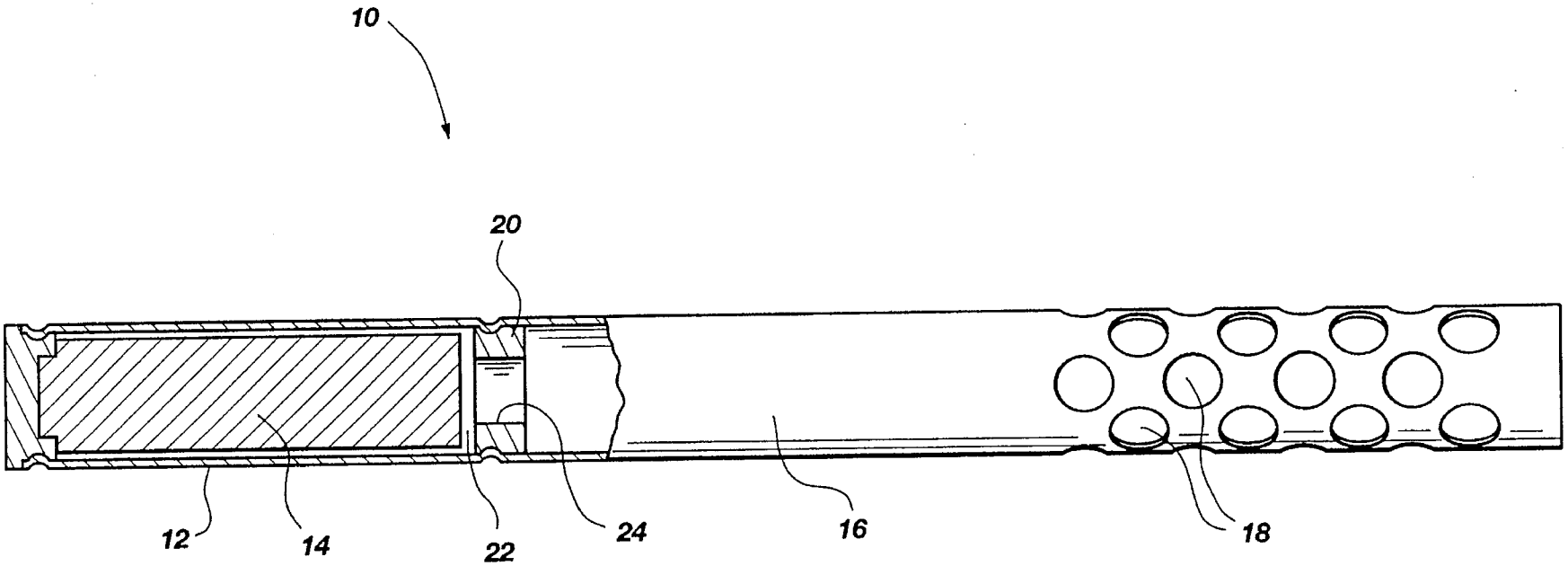
FIG. 1 is a side, plan view of one embodiment of a decoy flare made according to the present invention, with a portion of the case illustrated in cross section.

Reference is now made to the figures wherein like parts are referred to by like numerals throughout. With particular reference to FIG. 1, a decoy flare according to the present invention is generally designated at 10. The flare 10 includes a case 12 in which an illuminant composition 14 is disposed.

The aft end of the case 12 includes a shroud 16 which is configured with a plurality of holes 18. A nozzle 20 is attached to the case 12 such that a combustion chamber 22 is defined inside the case. The nozzle 20 includes a throat 24 which is sized to provide a predetermined throat area. The nozzle 20 is positioned within the case 12 such that the shroud 16 extends beyond the nozzle 20.

The case 12 may be manufactured of any of those materials known for use in such an application, but is preferably made of 304 stainless steel seamless tubing. The bore of the case 12 preferably has a substantially constant diameter and is sized such that the ratio of the length of the case 12 to the bore diameter is from about 10:1 to about 12:1.

For flares designed to be ejected from aircraft, the bore diameter and length must be selected such that the flare 10 will be compatible with any preexisting chaff dispensers. For such flares, the bore diameter will generally be between about 0.75 inches and about 2.5 inches with the case 12 having a length of from about eight to about 18 inches. One presently preferred embodiment of the invention, as illustrated in FIG. 1, has a length of 7.5 inches and a diameter of 0.875 inches, resulting in a length-to-diameter ratio of 8.5:1.

The holes 18 in the shroud 16 are preferably positioned such that they are located in the approximate aft third of the case 12, as is illustrated in FIG. 1. In this presently preferred embodiment, the holes 18 are equally spaced and extend around the entire perimeter of the aft portion of the shroud 16 in the geometric configuration as illustrated. The holes 18 are preferably configured to be substantially circular, with a diameter less than about half of the diameter of the bore of the case. In the preferred embodiment illustrated in FIG. 1, the holes have a diameter of between about 0.375 and about one inch.

As will be appreciated by one of skill in the art, however, the size, shape, number, and arrangement of the holes may be modified to control the "effective length" of the case while achieving a predetermined actual length to satisfy any ejection and packaging requirements imposed on the flare. Indeed, in some embodiments, it may be desirable not to employ any holes in the shroud 16.

The illuminant composition 14 preferably comprises a propellant composition, thereby enabling the decoy flare 10 to be propelled in a direction which is beneficial in countering air-to-air and surface-to-air missiles. The illuminant composition may comprise any of those known compositions which produce radiation upon combustion. The illuminant composition may be tailored to produce light over a variety of wavelengths, including visible and/or infrared light.

The formulation and loading of the illuminant composition 14 into the case 12 may be done by any of those methods known to one of skill in the art. Importantly, however, the geometry of the propellant grain must be tailored to a predetermined shape to achieve an unstable combustion condition, as described below.

In accordance with the teachings of the present invention, the illuminant composition 14, the nozzle throat area, the geometry of the illuminant composition, and the volume of the combustion chamber 22 are selected such that combustion of the illuminant composition 14 results in an unstable combustion condition, thereby increasing the peak intensity of the radiation emitted by the propellant. IR seeking missiles see peak intensity; thus, the fact that the intensity is rapidly fluctuating does not impair the effectiveness of the decoy flare.

Additionally, because the seduction phase of the decoy flare's mission is very short, usually only a fraction of a second during the first second of deployment of the flare, even a short period of unstable combustion of the illuminant composition can effectively accomplish the purposes of the flare. Hence, the illuminant composition 14, the nozzle throat area, the geometry of the illuminant composition, and the volume of the combustion chamber 22 are selected to provide an unstable combustion condition during the first second of combustion. Preferably, these parameters are set relative to each other such that the unstable combustion occurs during the first 0.2 to 0.5 seconds of combustion of the illuminant composition.

Unstable combustion can generally be predicted by observing the relationship between two variables, L* and $K_n$, where $$L^* = \frac{V}{A_T}$$

and $$K_N = \frac{A_S}{A_T},$$

where V is the free chamber volume measured in cubic inches, $A_T$ is the throat area measured in square inches, and $A_S$ is the area of the surface of combustion of the propellant or illuminant measured in square inches.

Figure 2:
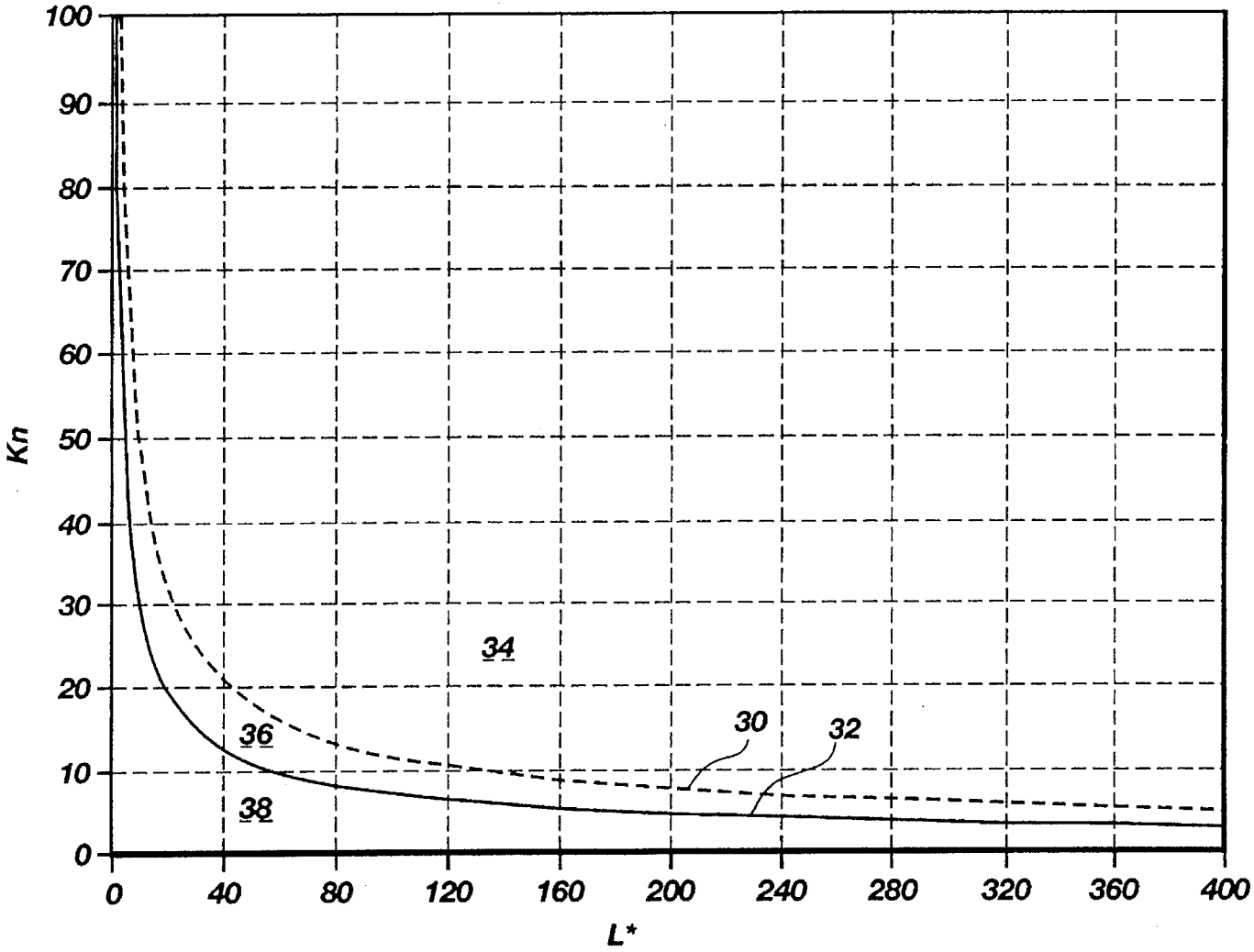
FIG. 2 is graph in which the relationship between L* and $K_n$ which will yield unstable combustion for a particular illuminant composition is illustrated.

For a particular illuminant composition, the relationship between L* and $k_n$ which will yield unstable combustion can be determined and plotted. The graph illustrated in FIG. 2 depicts such a relationship. The graph includes an upper boundary 30 and a lower boundary 32. The boundaries 30 and 32 may be determined experimentally or analytically. If the relationship between L* and $K_n$ is such that the combustion conditions fall in the area 34 above the boundary 30, combustion will be stable. If the combustion conditions fall in the area 36 between the boundaries 30 and 32, combustion will be unstable. Finally, if the combustion conditions fall within the area 38 below the boundary 32, combustion will extinguish.

A review of these equations illustrates that L* and $K_n$ are a function of the nozzle throat area, the geometry of the illuminant composition, and the volume of the combustion chamber. Thus, by carefully selecting these parameters according to the combustion stability boundaries for a given illuminant composition, unstable combustion can be induced.

Advantageously, unstable combustion produces pulses of increased pressure which cause the illuminant composition to burn at a higher rate than would occur during stable combustion. This increase in burn rate produces a corresponding increase in the peak intensity of the radiation being emitted.

Figure 3:
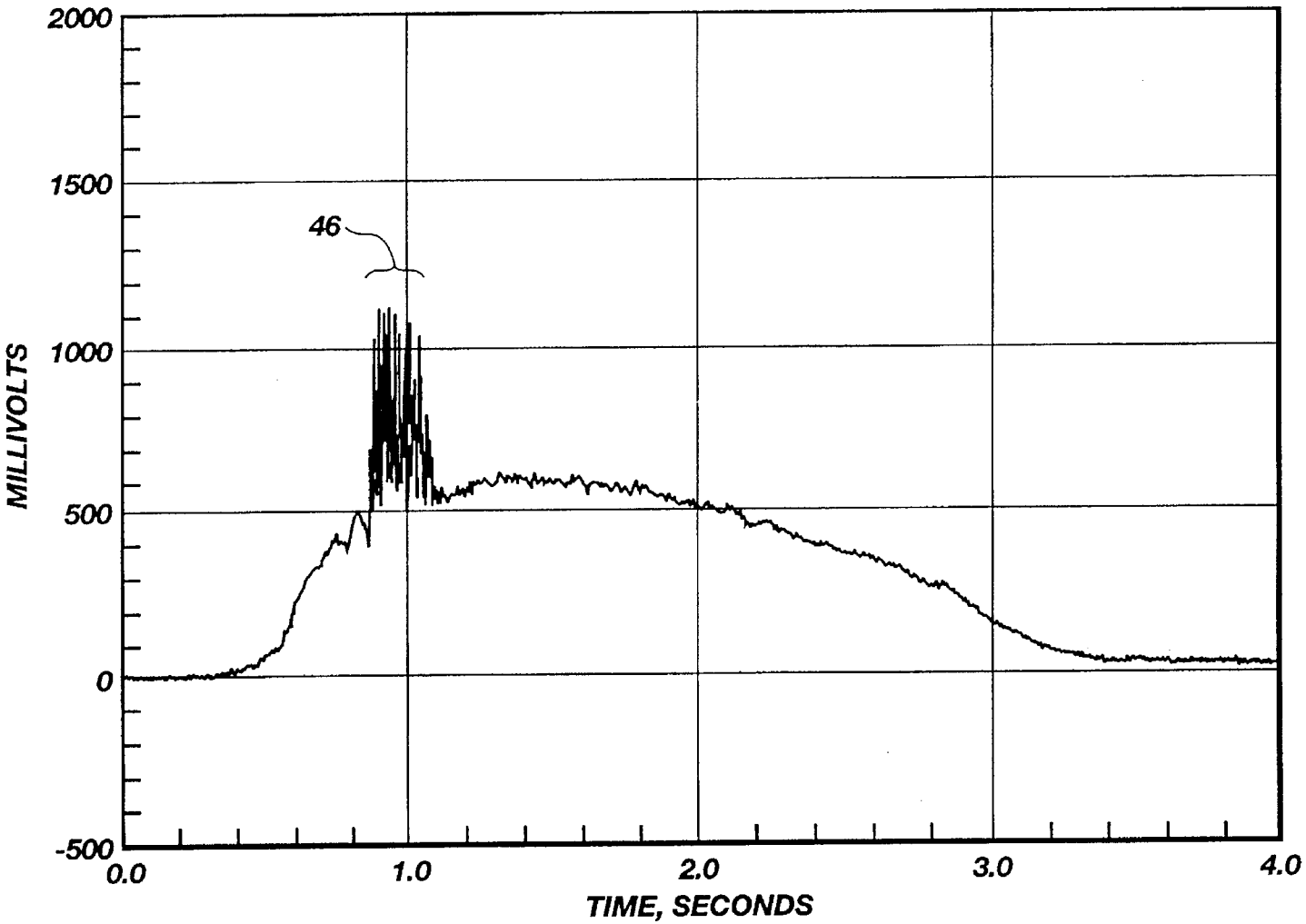
FIG. 3 is a graph which plots time versus intensity of emitted radiation during the burn of a decoy flare made in accordance with the teachings of the present invention.

The graph illustrated in FIG. 3 plots time versus intensity of emitted radiation during the burn of a decoy flare in accordance with the teachings of the present invention. During the period 46 from about 0.8 seconds to about 1.1 seconds, the combustion of the illuminant composition was unstable. Consequently, the peak intensity of infrared radiation emitted by the flare was approximately 826 Watts/steradian.

After about 1.1 seconds of combustion, the combustion parameters crossed the unstable boundary and combustion became stable. As illustrated in this example, the peak intensity during stable combustion was about 450 Watts/steradian. Thus, in this example, the utilization of an unstable combustion condition to increase peak intensity resulted in almost a two-fold increase in peak intensity output over that which was achieved during stable combustion.

The duration and start time of unstable combustion can be controlled by selection of the appropriate relationship between the illuminant composition 14, the nozzle throat area, the geometry of the illuminant composition, and the volume of the combustion chamber 22. Thus, the decoy flare 10 of the present invention may be configured such that peak intensity output occurs at a critical time period to most effectively counter air-to-air and surface-to-air missiles, i.e., during the first second of combustion of the flare illuminant.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A decoy flare, comprising:

a case;

an illuminant composition disposed in the case, the illuminant composition capable of emitting radiation upon combustion; and a nozzle attached to the case, the nozzle defining a combustion chamber inside the case, the nozzle including a throat, wherein the illuminant composition, the nozzle throat area, the geometry of the illuminant composition, and the volume of the combustion chamber are selected such that combustion of the propellant results in an unstable combustion condition thereby generating pressure pulses which result in increasing the peak intensity of the radiation emitted by the illuminant composition.

2. A decoy flare as defined in claim 1, wherein the illuminant composition, the nozzle throat area, the geometry of the illuminant composition, and the volume of the combustion chamber are selected such that the unstable combustion occurs during the first second of combustion of the illuminant composition.

3. A decoy flare as defined in claim 2, wherein the illuminant composition, the nozzle throat area, the geometry of the illuminant composition, and the volume of the combustion chamber are selected such that the unstable combustion occurs during the first 0.5 seconds of combustion of the illuminant composition.

4. A decoy flare as defined in claim 1, wherein the case comprises a shroud extending beyond the nozzle.

5. A decoy flare as defined in claim 4, wherein the case has a length to width ratio of from about four to about twelve.

6. A decoy flare as defined in claim 4, wherein the shroud is configured with a plurality of holes.

7. A decoy flare as defined in claim 6, wherein the case has an aft end and the holes are located in the aft third of the case.

8. A decoy flare as defined in claim 7, wherein the case has a substantially constant bore and the holes are substantially circular with a diameter less than about half of the diameter of the bore of the case.

9. A decoy flare as defined in claim 8, wherein the length of the case is from 8 to 18 inches, the diameter of the case is from 0.75 to 2.5 inches, and the diameter of the holes is from 0.375 to one inch.

10. A decoy flare as defined in claim 1, wherein the illuminant composition comprises a propellant composition.

11. A decoy flare as defined in claim 1, wherein the illuminant composition produces infrared radiation as it combusts.

12. An infrared decoy flare, comprising:

a case including a shroud configured with a plurality of holes;

propellant disposed in the case, the propellant capable of emitting infrared radiation upon combustion; and a nozzle attached to the case, the nozzle defining a combustion chamber inside the case and positioned within the case such that the shroud extends beyond the nozzle, the nozzle including a throat, wherein the propellant composition, the nozzle throat area, the geometry of the propellant, and the volume of the combustion chamber are selected such that combustion of the propellant results in an unstable combustion condition during the first second of combustion, thereby generating pressure pulses which result in increasing the peak intensity of the infrared radiation emitted by the propellant.

13. A decoy flare as defined in claim 12, wherein the propellant composition, the nozzle throat area, the geometry of the propellant and the volume of the combustion chamber are selected such that the unstable combustion occurs during the first 0.5 seconds of combustion of the propellant.

14. A decoy flare as defined in claim 12, wherein the case has an aft end and the holes are located in the aft third of the case.

15. A decoy flare as defined in claim 14, wherein the case has a substantially constant bore and the holes are substantially circular with a diameter less than about half of the diameter of the bore of the case.

16. A decoy flare as defined in claim 15, wherein the length of the case is from 8 to 18 inches, the diameter of the case is from 0.75 to 2.5 inches, and the diameter of the holes is from 0.375 to one inch.

17. A method of decoying light-seeking missiles, comprising the steps of:

preparing a decoy flare having a case, an illuminant composition disposed in the case, the illuminant composition capable of emitting radiation upon combustion, and a nozzle attached to the case, the nozzle defining a combustion chamber inside the case, the nozzle including a throat having a throat area, wherein the propellant composition, the nozzle throat area, the geometry of the illuminant composition, and the volume of the combustion chamber are selected such that combustion of the illuminant composition results in an unstable combustion condition;

deploying the decoy flare; and igniting the illuminant composition thereby causing an unstable combustion condition to occur which generates pressure pulses which increase the peak intensity of the radiation emitted by the illuminant composition.

* * * * *